US005317377A

United States Patent [19]

Rubscha et al.

[11] Patent Number: 5,317,377

[45] Date of Patent: May 31, 1994

[54] INVERTER APPARATUS CAPABLE OF INVERTING A3 OR 11×17" SHEETS

[75] Inventors: Robert F. Rubscha; Robert H. Alexander, Jr., both of Fairport; Glenn M. Keenan, Rochester; Paul R. Lagonegro, Henrietta, all of N.Y.

[73] Assignee: Xerox Corporation, Stamford, Conn.

[21] Appl. No.: 767,001

[22] Filed: Sep. 27, 1991

[51] Int. Cl.[5] ..... G03G 21/00

[52] U.S. Cl. ..... 355/319; 271/186; 355/24; 355/311

[58] Field of Search ..... 355/308, 309, 318, 316, 355/319, 311, 24, 26, 23; 271/185, 186

[56] References Cited

U.S. PATENT DOCUMENTS

| | | | |
|---|---|---|---|
| 3,416,791 | 12/1968 | Beckman, Jr. et al. | 271/65 |
| 4,176,945 | 12/1979 | Holzhauser et al. | 271/186 X |
| 4,359,217 | 11/1982 | Roller et al. | 271/186 |
| 4,487,506 | 12/1984 | Repp et al. | 355/319 |
| 4,579,444 | 4/1986 | Pinckney et al. | 355/311 X |
| 4,673,176 | 6/1987 | Schenk | 271/186 |
| 4,734,738 | 3/1988 | Yamanaka et al. | 355/318 |
| 4,769,674 | 9/1988 | Kitajima et al. | 355/318 X |
| 4,782,363 | 11/1988 | Britt et al. | 355/319 X |
| 4,918,490 | 4/1990 | Stemmle | 355/318 |
| 4,943,832 | 7/1990 | Emori | 355/319 X |
| 4,975,749 | 12/1990 | Tsunoda et al. | 355/319 X |
| 5,055,885 | 10/1991 | Yoshikado et al. | 355/318 |
| 5,132,742 | 7/1992 | Goto | 355/319 |
| 5,187,530 | 2/1993 | Watanabe | 355/308 |

*Primary Examiner*—A. T. Grimley
*Assistant Examiner*—Shuk Y. Lee

[57] ABSTRACT

A printer capable of producing simplex and duplex copies includes a tri-roller inverter that employs a passive deflector gate downstream from input and output nips of the tri-roller inverter. A sheet driven by the input nip into a reversing chute of the inverter deflects the passive deflector gate to an open position that allows the sheet to enter the inversion chute and after the sheet is past the gate it returns to close deposition, thus allowing the sheet to be driven past it in reverse by a reversing roller. Once the lead edge of the reversed sheet passes the passive deflector gate, a second sheet enters the input nip resulting in two sheets being in the inverter at the same time.

16 Claims, 4 Drawing Sheets

INVERTER APPARATUS CAPABLE OF INVERTING A3 OR 11×17" SHEETS

BACKGROUND OF THE INVENTION

The present invention relates to an improved sheet inverting system, and more particularly to an inverter adapted to be placed within the normal paper path of a copier while providing improved handling of variable sized sheets, as well as, curled sheets within the inverter.

As xerographic and other copiers increase in speed, and become more automatic, it is increasingly important to provide higher speed yet more economical, reliable and more automatic handling of both the copy sheets being made by the copier and the original document sheets being copied. It is desired to accommodate sheets which may vary widely in size, weight, thickness, material, condition, humidity, age, etc. These variations change the beam strength of flexural resistance and other characteristics of the sheets. Yet, the desire for automatic and high speed handling of such sheets without jams, misfeeds, uneven feeding times, or other interruptions increases the need for reliability of all sheet handling components. A sheet inverter is one such sheet handling component with particular reliability problems and sheet handling size and capability limitations.

Although a sheet inverter is referred to in the copier art as an 'inverter', its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the 'inverter' is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion.

Typically in a reversing chute type inverter, the sheet is fed in and then wholly or partially released from a positive feeding grip or nip into the inverter chute, and then reacquired by a different feeding nip to exit the inverter chute. Such a temporary loss of positive gripping of the sheet by any feed mechanism during the inversion increases the reliability problems of such inverters.

As noted above, many inverters, particularly those utilizing only gravity, have reliability problems in the positive output or return of the sheet at a consistent time after the sheet is released in the inverter chute. Those inverters which use chute drive rollers or other drive mechanisms of the type disclosed in U.S. Pat. No. 3,416,791, have a more positive return movement of the sheet, but this normally requires a movement actuator (clutch or solenoid) for the drive and either a sensor or a timing mechanism to determine the proper time to initiate the actuation of this drive mechanism so that it does not interfere with the input movement of the sheet, and only thereafter acts on the sheet to return it to the exit nip or other feed-out areas. Further, inverter reliability problems are aggravated by variations in the condition or size of the sheet. For example, a pre-set curl in the sheet can cause the sheet to assume an undesirable configuration within the chute when it is released therein, and interfere with feed-out.

U.S. Pat. No. 4,673,176 discloses a tri-roll inverter that is used in a copier for producing simplex and duplex copies and includes a corrugation roll-on-roll return force applicator located downstream of and offline an input nip of the inverter. A sheet driven by the input into the inverter is corrugated as it penetrates the roll-on-roll return force applicator nip. When the last position of the sheet is driven into the return force applicator nip, the friction return force will cause the sheet to drive into a foam roll which delivers the sheet to an output nip. The inverter is capable of handling two sheets simultaneously. However, none of the abovementioned devices are capable of handling the demonstrated need for duplexing A3 and 11×17" sheets.

SUMMARY OF THE INVENTION

Accordingly, in an aspect of the present invention, an inverter apparator is disclosed that efficiently handles A3 and 11×17" sheets with ease for duplexing purposes. A sheet is directed into the inverter from a transport by a decision gate activated by a solenoid where it moves through a first pinch roller nip of a tri-roller system and is driven past a passive decision gate to a reversing drive roller to the extent where the trial edge of the sheet reaches a predetermined point, where it is reversed and exited through a second pinch roller nip of the tri-roller system to a vertical transport, at which time the next sheet enters the system. The new entering sheet and the exiting sheet are in the inverter at the same time.

BRIEF DESCRIPTION OF THE DRAWINGS

Further features and advantages of the present invention pertaining to the particular apparatus, steps and details whereby the above-identified aspects of the invention are attained will be included below. Accordingly, the invention will be better understood by reference to the following description, and to the drawings forming a part thereof, which are approximately to scale, wherein.

Describing now in further detail the exemplary embodiment with reference to the Figures, there is shown a duplex printer reproducing machine 10 by way of one example of an apparatus in which the particular disclosed apparatus of the present invention may be utilized.

The following terms re the specific example here are hereby defined. "UI" is the User Interface, in this case the interactive CRT, or liquid crystal or other operator control console display panel and touch area or switch inputs connected to the system controller or ESS. It may also be called a UIT or User Interface Terminal. This UI is where document handling, or finisher or other machine functions or modes are programmed in by the operator. The disclosed system can be used to determine, for example, which of the five document handling modes (Recirculating Document Handler (RDH), (Semi-Automatic Document Handler (SADH), Computer Forms Feeder (CFF), Platen, and Book copying) the operator is trying to use for scanning. E.G., document scanning in Book Mode or CFF Mode are "selected" by the operator at the UIT in this example. ESS is the Electronic Sub-System or system control. IIT is the Image Input Terminal, also called a scanner in this example, but it does more than just image scan here. (Another term for this is EFE or Electronic Front End). IOT is the Image Output Terminal, which writes or prints (with a laser beam) the marks on the (copy) paper. DH is the overall Document Handler, or feeder, also referred to hereinbelow as the "UDH" or universal document handler with both an RDH document stacking tray input and a SADH/CFF document input into which either computer form web (usually fan-fold) feeding (CFF) or large or other individual documents may be loaded and fed.

Figure 1:
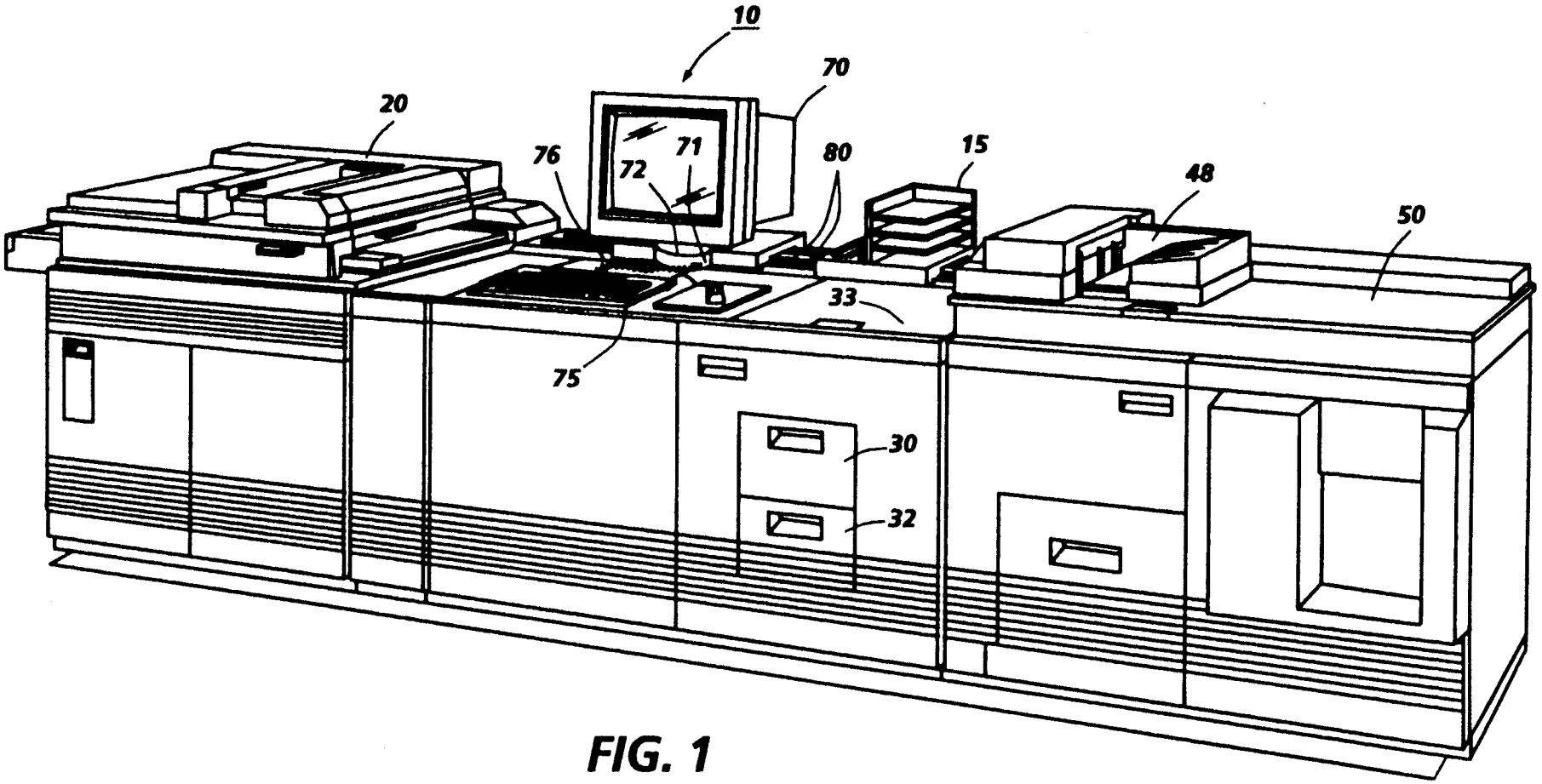
FIG. 1 is an isometric elevation view of one embodiment of a printer incorporating the present invention.
Figure 2A:
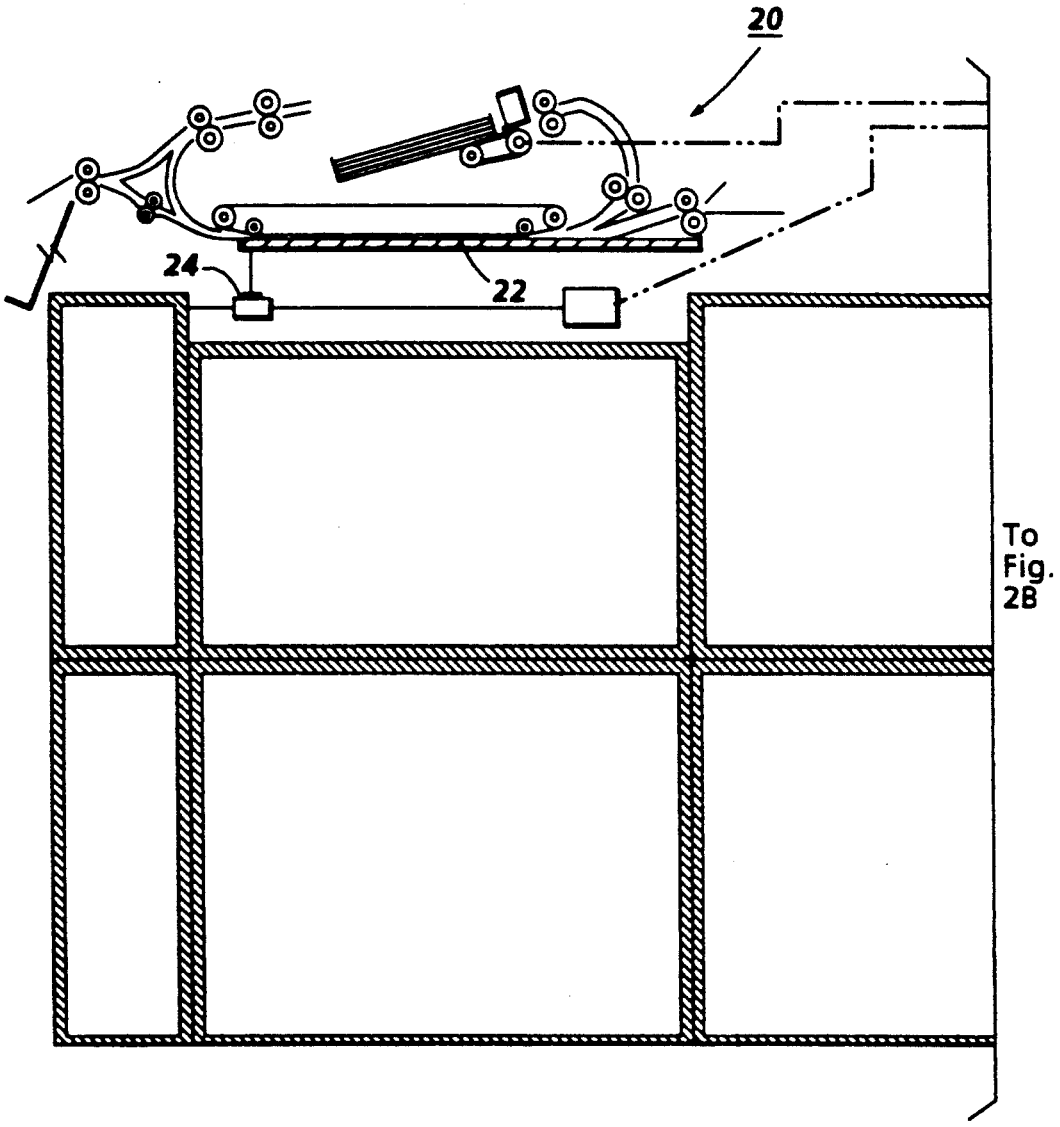
FIGS. 2A and 2B show a schematic partial side view of the printer of FIG. 1 incorporating one example of the subject invention.
Figure 2B:
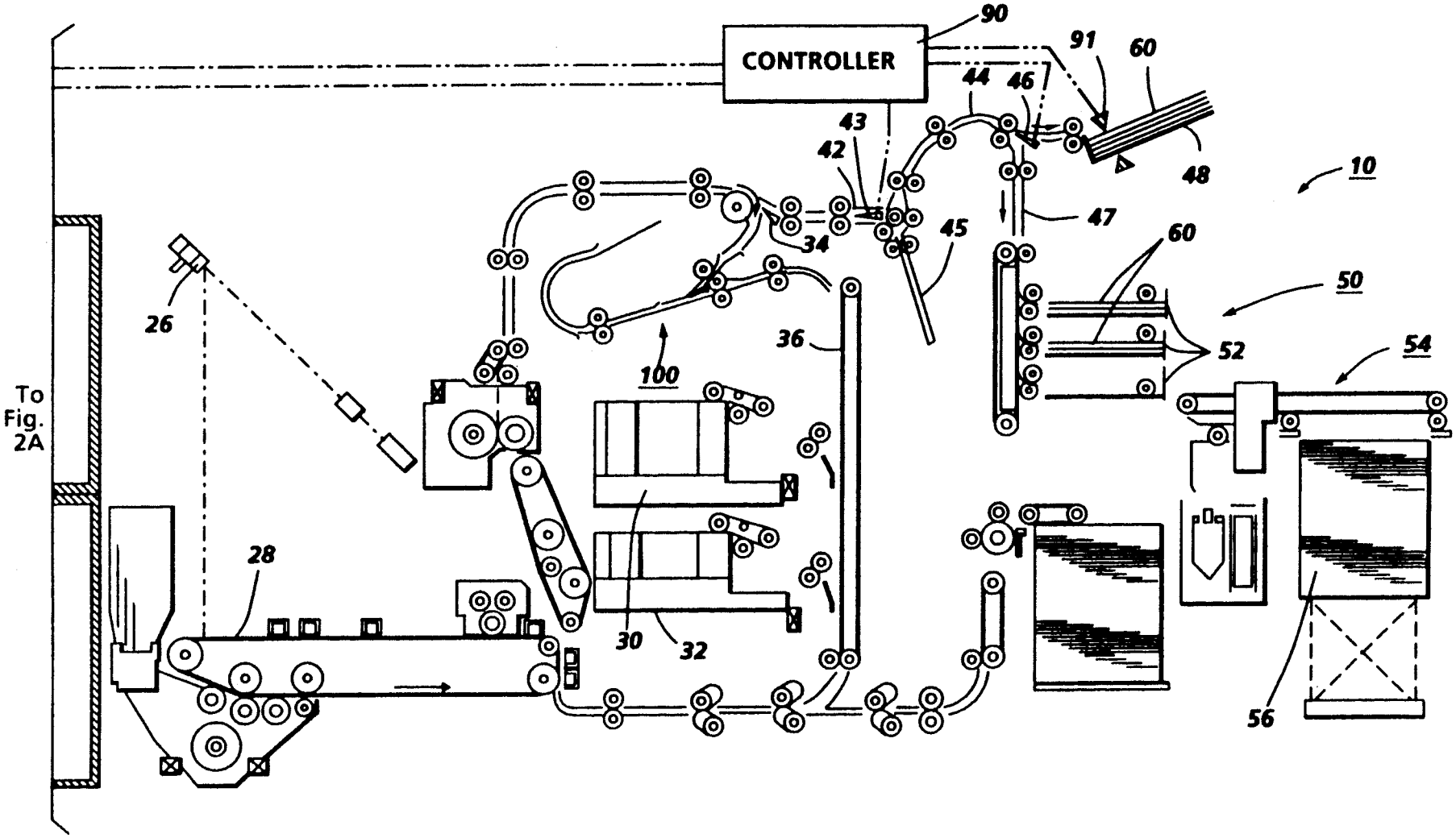
Figure 3:
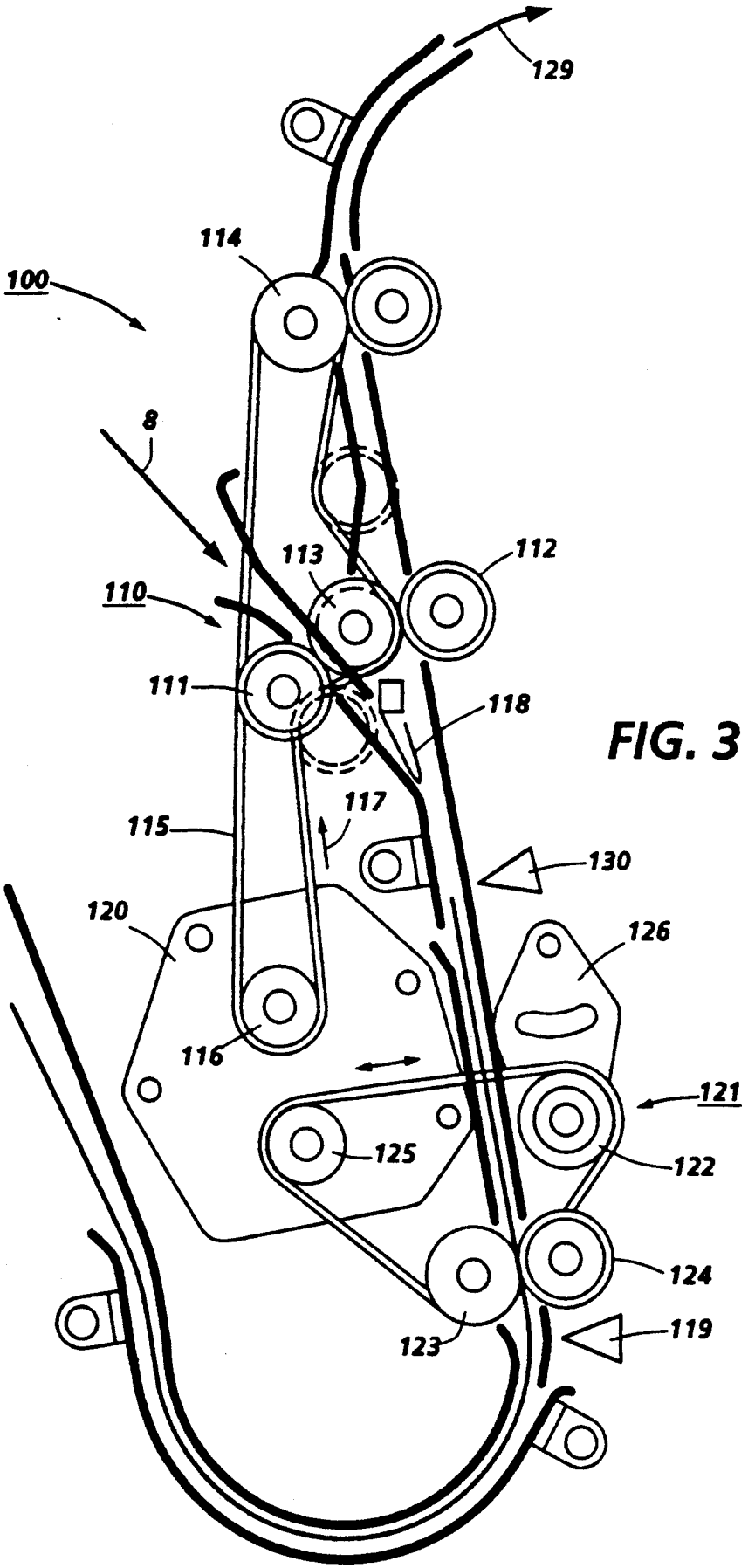
FIG. 3 is an enlarged schematic partial side view of the inverter apparatus of the present invention that has been rotated approximately 90 degrees.

As disclosed in FIGS. 1, 2A and 2B, the printer 10 and its original document presentation system 20 in FIG. 2A may be like that disclosed in Xerox Corporation U.S. Pat. No. 4,782,363, issued Nov. 1, 1988 to J. E. Britt, et al. An electronic document imaging system 24, and a laser scanning system 26 imaging a photoreceptor 28, may be provided as shown here and in the above U.S. Pat. No. 4,782,363. Alternatively, this may be a conventional optical imaging system. As discussed above, operator inputs and controls and machine internal controls and operator displays and "prompts" or instructions are provided in a controller 90 with displays. The document handler may also be like that in Xerox Corporation U.S. Pat. No. 4,579,444, and the finisher disclosed herein is like that shown and described in Xerox Corporation U.S. Pat. No. 4,782,363, and its cross-referenced applications.

Here, in the printer 10 of FIG. 2B, a generally conventional xerographic system example is shown, with clean paper trays 30 and 32 feeding unimaged copy sheets or other substrates through a paper path to be imaged at the transfer area of engagement with the photoreceptor 28. Then the copy sheets are fused and outputted sequentially via path 42. Alternatively, for duplex (two-sided) copies, the copy sheets may be diverted to an inverter 100 in accordance with the present invention, and returned via belt 36 for second side imaging before being outputted via path 42. In the output path 42 a selectable deflector gate 43 may be provided to invert the copy sheets via an inverter 45 if gate 43 is actuated. Then the copy sheets pass on via path 44 to an output station selection gate 46.

If the sheet deflector gate 46 is selected by the operator (via controller 90 inputs and software) to be up, as shown, all copy sheets 60 after that are deflected into a finisher path 47 to the finisher 50 compiler trays 52, from which the completed copy sets are removed via transport 54 and bound or stapled and output stacked in stacker 56. Alternatively, if the gate 46 is selected by the operator to be down, then all outputting copy sheets after that are deflected into a readily accessible top tray 48. The presence or absence of any sheets in that top tray 48 is sensed by a conventional optical or flag sensor 91 conventionally connecting with the controller 90.

FIG. 1 UIT 70 is slidably mounted, e.g., on rollers, for lateral movement on tracks 80 by a light touch on base 71. An optional work organizer 15 is also slidable on the same tracks 80 for the convenience of the operator, in this example. This comprises trays in which documents or copies may be stored. With work organizer 15 removed, UIT 70 is slidable to the left as view in FIG. 1 to a position adjacent document handler 20 for programming of document sets at the document handler and alternatively is slidable, to the right and adjacent finisher 50 for reprogramming of copy sets based upon changing requirements. A flexible cord 76 is connected the UIT as well as to keyboard 75 to allow the lateral movement of the UIT while maintaining programming capability. Movement of UIT 70 also facilitates the clearing of any jams that might occur in the paper path under cover 33.

Inverter 100, in accordance with the present invention, facilitates automatic inversion or duplexing of A3 and 11×17 inch sheets. A sheet to be duplexed is directed into the inverter from the top transport by a conventional decision gate 34 actuated by a solenoid (not shown) and enters the inverter in the direction of arrow 8 and is captured by rollers 111 and 113 which form an input nip of tri-roller 110. The input nip is driven by a belt 115 rotatably driven by a conventional connected to drive rollers 113 and 114. The belt 115 is drivingly connected to drive roller 113 which in turn drives idler rollers 111 and 112 in a clockwise and counter-clockwise direction respectively while being rotated in the direction of arrow 117. The input nip drives the sheet into and past a passive decision gate 118 which is made of a suitable flexible material, such as, Mylar, a trademark of E. I. DuPont de NeMours & Company, or spring loaded sheet metal. The force of the sheet pushes gate 118 downwardly and in a counter-clockwise direction. While the sheet is being driven by the input nip, passive gate 118 guides the sheet past conventional optical sensors to reversing rollers 123 and 124. Reversing roller 123 is the driving roller and forms a nip with idler roller 124. A gear box 120 which includes two electromagnetic clutches 116 and 125, gears (not shown), pulleys (not shown) and a belt 121 entrained around reversible drive roller 123 and tensioner 122 mounted on support member 126. Optical sensors (not shown) located in the paper path control gear box 120 which drives the paper until the trail edge reaches point 130. The gear box then reverses direction and thereby makes the former trail edge of the sheet become the new leading edge of the sheet. The sheet is driven to the lower portion of passive gate 118 and into an exit nip of tri-roller member 110 formed by drive roller 113 and driven idler roller 112 which in turn drives the sheet out of the inverter in the direction of arrow 129. If the sheet did not leave the nip formed between reversible drive roller 123 and idler roller 124, a sensor at point 119 will indicate that a jam has occurred. An advantage of inverter 100 is that passive decision gate 118 allows the next sheet to enter the input nip while the new trail edge of the previous sheet is still exiting which increases productivity.

It should now be understood that an inverter has been disclosed that accomplishes duplexing of A3 and 11×17 inch copy sheets where paper is directed into the inverter from a top transport by a decision gate that is actuated by a solenoid. The sheet is moved through the top pinch roller of a tri-roller system and is driven past a passive decision gate to a reversing drive roller which drives the sheet in the same direction to an extent where the trial edge reaches a predetermined point, where it is reversed exiting through the lower pinch roller of the tri-roller system to the vertical transport, at which time the next sheet enters the inverter.

While the embodiment disclosed herein is preferred, it will be appreciated from this teaching that various alternatives, modifications, variations or improvements therein may be made by those skilled in the art which are intended to be encompassed by the following claims.

What is claimed is:

1. In an inverter apparatus that includes a tri-roller inverter mechanism having an input nip for driving sheets into a reversing chute, an output nip for driving sheets out of the reversing chute and a reversing drive roller adapted to drive sheet into the output nip to reverse the lead and trail edge orientation of the sheets, the improvement comprising:

a sole, flexible, non-rotatable, passive gate means closely spaced to and positioned downstream from said input nip for being deflected to an open position by movement of a sheet therepast by said input nip and returning to a closed position after the sheet has past, and wherein said gate means has a portion thereof in substantially the same plane of said reversing chute when said gate means is in said closed position in order to enable the lead edge of the reversed sheet to be moved therepast by said reversing drive roller, and wherein said passive gate means is opened only by movement of a sheet therepast and closes automatically after the sheet passes said passive gate means due to its flexibility.

2. A substrate inverter, comprising:

(a) an inversion chute having a curved portion;

(b) input drive means for driving a substrate into said chute in an initial direction and subsequently into said curved portion of said inversion chute;

(c) flexible, passive deflector gate means serving as the sole gate means for directing sheets into and out of said inversion chute for opening and closing access to said inversion chute by a substrate fed from said input drive means, and wherein said passive deflector gate means is opened only by movement of a sheet therepast and closes automatically after the sheet passes said passive gate means due to its flexibility; and (d) output drive means positioned directly adjacent said input drive means for driving a substrate out of said chute in an output direction generally opposite but in substantially the same plane as said initial incoming substrate direction and past said passive deflector gate means.

3. The inverter of claim 2, including reversing drive means for driving a sheet into and out of said chute.

4. The inverter of claim 3, including sensor means for sensing the trail edge of a sheet coming into said chute and triggering reversing movement of said reversing drive means for driving the sheet out of said chute.

5. A method of inverting a substrate, comprising the steps of:

(a) providing an inversion channel having a curved portion thereof to facilitate the inversion of substrates therein;

(b) providing input drive means for driving an incoming substrate into said inversion channel and into said curved portion of said inversion channel;

(c) providing a flexible, passive deflector gate serving as the sole gate means for directing sheets into and out of said inversion channel downstream from said input drive means that is positioned to close off entrance of the incoming substrate to said inversion channel;

(d) opening said flexible, passive deflector gate only by driving the incoming substrate therepast;

(e) providing a reversing drive roller nip;

(f) sensing the trail edge of the incoming substrate and actuating said reversing drive roller nip to reverse direction of the incoming substrate and drive the now outgoing substrate past said passive deflector gate which is in a closed position after the incoming substrate had past it due to its flexibility; and (g) providing output drive means positioned directly adjacent said input drive means and within substantially the same plane extending through said reversing drive roller nip for driving the outgoing substrate out of the inverter, thereby inverting the substrate.

6. A printer capable of producing simplex and duplex copies of a page image information includes an inverter apparatus having a tri-roller inverter mechanism with an input nip for driving sheets into a reversing chute, an output nip for driving sheets out of the reversing chute and a reversing drive roller adapted to drive sheet into the output nip to reverse the lead and trail edge orientation of the sheets, comprising:

a flexible non-rotatable passive gate serving as the sole gate means for directing sheets into and out of the chute positioned downstream from the input nip for being deflected to an open position by movement of a sheet by the input nip therepast, and wherein said flexible, passive gate is returned to a closed position after the sheet has past due to its flexibility in order to enable the lead edge of the reversed sheet to be moved therepast by the reversing drive roller.

7. A copier/printer includes a substrate inverter, comprising:

(a) an inversion chute including a curved portion thereof;

(b) input drive means for driving a substrate into said chute in an initial direction, and then into said curved portion of said inversion chute;

(c) flexible, passive deflector gate means serving as the sole gate means for directing sheets into and out of said inversion chute for opening and closing access to said chute by a substrate fed from said input drive means, and wherein said flexible, passive deflector gate means is opened only by movement of a sheet therepast and closes automatically after the sheet passes said passive deflector gate means due to its flexibility; and (d) output drive means positioned directly adjacent said input drive means for driving a substrate out of said chute in an output direction generally opposite but in substantially the same plane as said initial incoming substrate direction and past said passive deflector gate means.

8. The inverter apparatus of claim 1, wherein said flexible, passive gate means is made of spring steel.

9. The substrate inverter of claim 2, wherein said flexible, passive deflector gate means is made of spring steel.

10. The printer of claim 6, wherein said flexible, passive gate is made of spring steel.

11. The printer of claim 7, wherein said flexible, deflector passive gate means is made of spring steel.

12. A printer capable of producing simplex and duplex copies of a page image information includes an inverter apparatus capable of simultaneously handling two A3 or 11×17" sheets having a tri-roller inverter mechanism with an input nip for driving sheets into a reversing chute, an output nip for driving sheets out of the reversing chute and a reversing drive roller adapted to drive sheet into the output nip to reverse the lead and trail edge orientation of the sheets, comprising:

a flexible, passive gate means serving as the sole gate means for directing sheets into and out of the chute positioned downstream from the input nip for being deflected to an open position by movement of a sheet by the input nip therepast, and wherein said flexible, passive gate is returned to a closed position after the sheet has past due to its flexibility in order to enable the lead edge of the reversed sheet to be moved therepast by the reversing drive roller; and J-shaped, curved chute means adapted to accept and temporarily store a sheet in curved configuration in order to increase a size of sheet that can be inverted by the inverter apparatus.

13. A method of inverting substrates within an inversion channel, comprising the steps of:

(a) providing an inversion channel that is in curved, J-shaped configuration in order to increase a size of substrates that can be inverted;

(b) providing input drive means for driving an incoming substrate into said curved, J-shaped configuration of said inversion channel;

(c) providing a flexible, passive deflector gate serving as the sole gate means for directing sheets into and out of said inversion channel downstream from said input drive means that is positioned to close off entrance of the incoming substrate to said inversion channel;

(d) opening said flexible, passive deflector gate only by driving the incoming substrate therepast;

(e) providing a reversing drive roller nip;

(f) sensing the trail edge of the incoming substrate and actuating said reversing drive roller nip to reverse direction of the incoming substrate and drive the now outgoing substrate past said passive deflector gate which is in a closed position after the incoming substrate had past it due to its flexibility;

(g) providing output drive means positioned directly adjacent said input drive means and substantially within a plane extending through said reversing drive roller nip for driving the outgoing substrate out of the inverter after it has passed said passive deflector gate, thereby inverting the substrate; and (h) driving a second substrate into said inversion channel once said outgoing substrate passes said passive deflector gate, but before said outgoing substrate exits said inversion channel in order to accomplish simultaneous inversion of two substrates.

14. The inverter of claim 2, wherein said flexible, passive deflector gate means is in the same plane of said chute when it is in a closed, nonflexed position and extends into said chute when it is in an open, flexed position as a result of being engaged by a sheet.

15. The inverter of claim 2, wherein said chute has a wall portion and said flexible, passive deflector gate means forms part of said wall portion when a sheet exits said chute.

16. The inverter of claim 7, including channel means leading from said input drive means to the entrance of said inversion chute with an opening thereof in communication with said inversion chute, and wherein said flexible, passive deflector gate means closes off said opening when in a closed position.

* * * * *